US006267571B1

(12) United States Patent
Anderson et al.

(10) Patent No.: US 6,267,571 B1
(45) Date of Patent: Jul. 31, 2001

(54) HYDRAULIC DISPLACEMENT PUMP HAVING TWO STROKE LENGTH

(75) Inventors: Thomas M. Anderson, Hugo; Enrique Gomez, Woodbury, both of MN (US)

(73) Assignee: Schwing America, Inc., White Bear, MN (US)

( * ) Notice: Subject to any disclaimer, the term of this patent is extended or adjusted under 35 U.S.C. 154(b) by 0 days.

(21) Appl. No.: 09/376,144

(22) Filed: Aug. 17, 1999

(51) Int. Cl.[7] ..... F04B 11/00; F04B 17/00; F04B 15/02; F01L 15/00

(52) U.S. Cl. ..... 417/539; 417/403; 417/900; 91/189 R

(58) Field of Search ..... 417/539, 403, 417/399, 900; 91/189 R, 191, 193, 278

(56) References Cited

U.S. PATENT DOCUMENTS 3,994,627 * 11/1976 Calzolari ..... 417/317
5,024,584 * 6/1991 Bordini et al. ..... 417/900
5,199,857 * 4/1993 Sanuki ..... 417/319
5,346,368 * 9/1994 Oakley et al. ..... 417/900
5,619,965 * 4/1997 Cosma et al. ..... 123/322

* cited by examiner

*Primary Examiner*—Charles G. Freay
*Assistant Examiner*—Michael K. Gray
(74) *Attorney, Agent, or Firm*—Kinney & Lange, P.A.

(57) ABSTRACT

A pump having both a short stroke pumping mode and a long stroke pumping mode. The pump has two material cylinders, each with an attached hydraulic cylinder for operating a piston rod extending through both the material and hydraulic cylinders. The piston rods are driven by hydraulic fluid supplied to the hydraulic cylinders and are synchronized so that as one piston rod extends, the other piston rod retracts. The piston rods draw material into the material cylinders when retracting, and pump material out of the material cylinders when extending. To pump in a short stroke mode, a diverter valve is placed between the hydraulic pump and the hydraulic cylinders which diverts an amount of hydraulic fluid to the cylinders, causing the hydraulic pistons to only be extended about half the length of the hydraulic cylinder.

14 Claims, 5 Drawing Sheets

HYDRAULIC DISPLACEMENT PUMP HAVING TWO STROKE LENGTH

CROSS-REFERENCE TO RELATED APPLICATION(S)

None.

BACKGROUND OF THE INVENTION

The present invention relates to a hydraulically driven viscous material pump. More particularly, the present invention relates to a hydraulic system which allows a concrete pump to pump in both a long stroke and short stroke mode.

Concrete pumps are used in a variety of applications in the construction field. Particularly, concrete pumps are used when the concrete must be placed in an area that is physically difficult to approach with a ready mix truck. Due to the nature of concrete, the pump must be rugged and wear resistant, and the flow of concrete must be as continuous as possible. Often, concrete pumps attempt to move the concrete at least every ten minutes and with clearing of the lines being required for stops over thirty minutes to an hour depending on the temperature and the concrete admixture.

Certain types of concrete, such as shotcrete and gunite, are shot at a high velocity under pressure, most often by using air, onto a form or other surface. Shotcreting has been used where a relatively thin section of concrete is needed, such as in shell roofs, walls, tanks, chimneys, swimming pools, jacuzzis, and cover and repair applications for all types of structures. Shotcrete is applied in layers of an inch to an inch and half thick, with the total thickness of up to four inches being obtained by successive placements. With advances in equipment, admixtures and mix designs, many jobs that have traditionally been form and pour are now being shotcreted.

Normally applying standard types of concrete and applying shotcrete require two entirely different types of concrete pumps to apply the material. As a result, contractors are forced to have two kinds of pumps if they wish to apply shotcrete and also work with standard concrete. Requiring two pumps greatly increases the cost to the construction company.

BRIEF SUMMARY OF THE INVENTION

The present invention is an improved dual cylinder material pump for pumping relatively viscous materials such as sludge or concrete. The invention can be operated in two modes, a long stroke mode and a short stroke mode. The concrete pump comprises two material cylinders having movable material pistons on piston rods inside. Connected to each material cylinder is a hydraulic cylinder which drives the hydraulic pistons located on the end of the piston rods opposite the material pistons. The pump operates using reciprocating piston rods so that as the piston rod in one material cylinder is retracting, material is drawn into the material cylinder. At the same time, the other piston rod is extending and material is extruded from the material cylinder. An output valve mechanism is used in conjunction with the synchronized piston rods to ensure a constant outflow of concrete.

The long stroke mode involves extending the hydraulic pistons in the hydraulic cylinder almost the entire length of the hydraulic cylinder. The second mode has a short length stroke which is approximately half the length of long stroke. The selection of the stroke length can be done manually by the pump operator. The benefit of the pump having two stroke lengths is that it allows the pump to operate at maximum efficiency under different operating conditions. The short stroke mode is used in shotcreting applications and has a better cylinder fill efficiency rate. The long stroke mode is used in regular concrete applications, where cylinder fill efficiency can be lower.

The change to the short stroke mode is effected by a valve which changes the volume of flow of hydraulic fluid to the hydraulic cylinders driving the pistons. In addition, two logic signal hydraulic valves monitor the position of the piston in the cylinder. When the piston reaches the short stroke valve, the short stroke valve signals a reciprocating cylinder valve to switch the flow of hydraulic fluid from one cylinder to the other. The short stroke valve also signals the output valve mechanism to change states.

DETAILED DESCRIPTION

Figure 1:
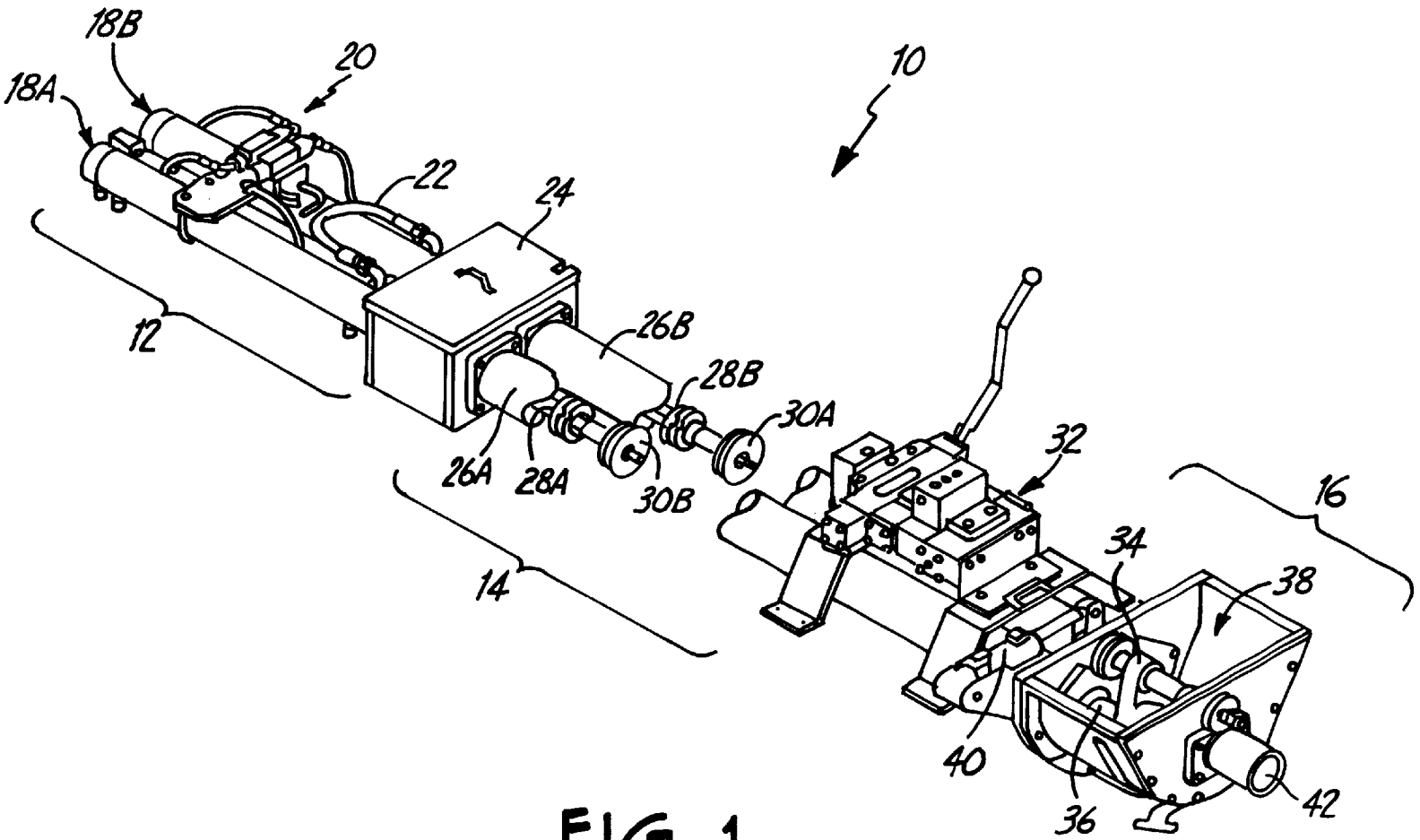
FIG. 1 is a perspective view of a concrete pump capable of pumping in both a short and long stroke mode.

FIG. 1 is a perspective view of a dual stroke hydraulic pump 10. The pump 10 can be divided into three areas; a hydraulic cylinder area 12, a material cylinder area 14, and a material output valve unit 16. The hydraulic cylinder area 12 includes differential cylinders 18A, 18B, differential cylinder hydraulic valves 20, an oil flow connecter 22, and a water box 24. The hydraulic valves 20 is connected to the differential cylinders 18A, 18B are part a hydraulic system described more fully below which allows the differential cylinders 18A, 18B to operate in either a short or long stroke mode. The oil flow connector 22 connects the two differential cylinders 18A, 18B and allows hydraulic fluid to flow across the connector 22 between the two cylinders 18A, 18B.

In the material cylinder area 14 are two material cylinders 26A, 26B, two piston rods 28A, 28B, and two material pistons 30A, 30B. The pistons 30A, 30B are located on the piston rods 28A, 28B, which are located inside the material cylinders 26A, 26B. The two sets of cylinders 18A, 18B, 26A, 26B are axially aligned so that the piston rods 28A, 28B extend through the material cylinders 26A, 26B and into the differential cylinders 18A, 18B. The piston rods 28A, 28B are caused to alternately extend or retract by hydraulic fluid forced into the differential cylinders 18A, 18B. When fully retracted, the piston rods 28A, 28B are located almost entirely within differential cylinders 18A, 18B. Conversely, when fully extended, the piston rods 28A 28B are located almost completely within the material cylinders 26A, 26B. As the piston rods 28A, 28B move forward or backward, they either draw material into the material cylinders 26A, 26B or force material out of the material cylinders 26A, 26B.

The material pistons 30A, 30B create a seal at the surface of the material cylinder 26A, 26B wall so that material cannot get behind the pistons 30A, 30B and into the piston hydraulics system 20 or the water box 24. The seal created by the pistons 30A, 30B also allows for material to be drawn into the material cylinders 26A, 26B. The water box 24 contains water with which to lubricate the cylinders 26A, 26B to both minimize friction in the cylinders 26A, 26B caused by the concrete being pumped through them, and prevent overheating. The water box 24 is also a final barrier for any material which may get behind the pistons 30A, 30B so that the material does not work its way back into the hydraulic system 20 or differential cylinders 18A, 18B. To further reduce friction, the inside of the material cylinders 26A, 26B is coated with a layer of chrome.

At the end of the material cylinder area 14 and next to the output valve unit 16 is control block 32. The control block 32 controls the hydraulic flow of fluid which operates the piston rods 28A, 28B and the material output valve unit 16. The material output valve unit 16 includes an output valve 34, material delivery holes 36, material hopper 38, slewing cylinder 40, and a material outlet 42. A material delivery hole 36 is located in the material hopper 38 directly in front of each material cylinder 26A, 26B. The delivery holes 36 allow material held in the hopper 38 to enter the material cylinders 26A, 26B as the piston rods 28A, 28B are retracted. The slewing cylinder 40 is connected to the output valve 34 and moves the output valve 34 back and forth so that it alternately covers one or the other material delivery holes 36. The output valve 34 is configured to redirect the flow of concrete from the material cylinders 26A, 26B through the hopper 38 to the outlet 42. Thus, as the piston rods 28A, 28B are extended, the material in the corresponding material cylinder 26A, 26B is forced out via the output valve 34 to the outlet 42.

In operation, the pump 10 is driven by hydraulic fluid moved by a hydraulic pump (not shown in FIG. 1). The pump supplies hydraulic fluid to the differential cylinders 18A, 18B via. As the differential cylinder 18A fills with fluid, the corresponding piston rod 28A is moved. The piston rods 28A, 28B are synchronized so that as one piston 28A is retracted, the other piston 28B is extended. To cause this synchronized movement, the oil flow connection 22 at the top of the differential cylinders 18A, 18B is a closed loop system of hydraulic fluid that allows fluid to pass between the differential cylinders 18A, 18B. Thus, as one piston rod 28A is extended due to hydraulic pressure in its associated differential cylinder 18A, the other piston rod 28B is forced to retract by the hydraulic fluid forced across the oil flow connection 22. On the intake stroke, the piston 28B draws in material and on the out take stroke, the piston 28A pushes the material out of the cylinders 26A, 26B. In this manner, the pump 10 continuously pushes material through the outlet 42.

To allow for material to be pushed through the outlet 42 at the same time material is being drawn in by a piston 28B, the output valve 34 pivots back and forth alternately closing off or opening a material delivery hole 36. More specifically, as the first piston 28A is being retracted, it draws concrete into the first material cylinder 26A. At the same time, the output valve 34 is positioned over the material delivery hole 36 at the second material cylinder 26B. As the piston rod 28B in the second material cylinder 26B is being extended, material in the material cylinder 26B is forced to the output valve 34. The output valve 34 connects the material delivery hole 36 to the outlet 42 so that the material in the second cylinder 26B is moved through the hopper 38 and to the outlet 42. When the next pump cycle begins, the output valve 34 changes position so that it now covers the material delivery hole 36 in front of the first material cylinder 26A, allowing the material in that cylinder 26A to be extruded through the output valve 34 to the outlet 42. At the same time, the delivery hole 36 in front of the second material cylinder 26B is unobstructed so that as the piston rod 28B retracts, the cylinder 26B fills with the concrete held in the hopper 38.

The pump 10 operates in both a long stroke and a short stroke mode. The long stroke mode refers to the pumping mode where the pistons 28A, 28B are fully retracted so that almost the entire material cylinder 26A, 26B is filled with concrete. The short stroke mode refers to the pumping mode wherein the pistons 28A, 28B are retracted only about half of the way so that only about half of the material cylinder 26A, 26B is filled with concrete. Pumping in the long stroke mode is used in standard concrete pumping applications, whereas short stroke pumping is used in shotcreting applications. The stroke length is controlled by the amount of hydraulic fluid supplied to the differential cylinders 18A, 18B. The main difference between long stroke and short stroke pumping is that short stroke pumping provides for better cylinder fill efficiency. Long stroke pumping results in about 80% cylinder fill efficiency due to more air being drawn into the cylinders along with the concrete. In the short stroke mode, the cylinder fill efficiency is raised to about 95%. The shorter distance traveled by the pistons 28A, 28B in the short stroke mode ensures more material and less air is drawn into the cylinders.

Figure 2A:
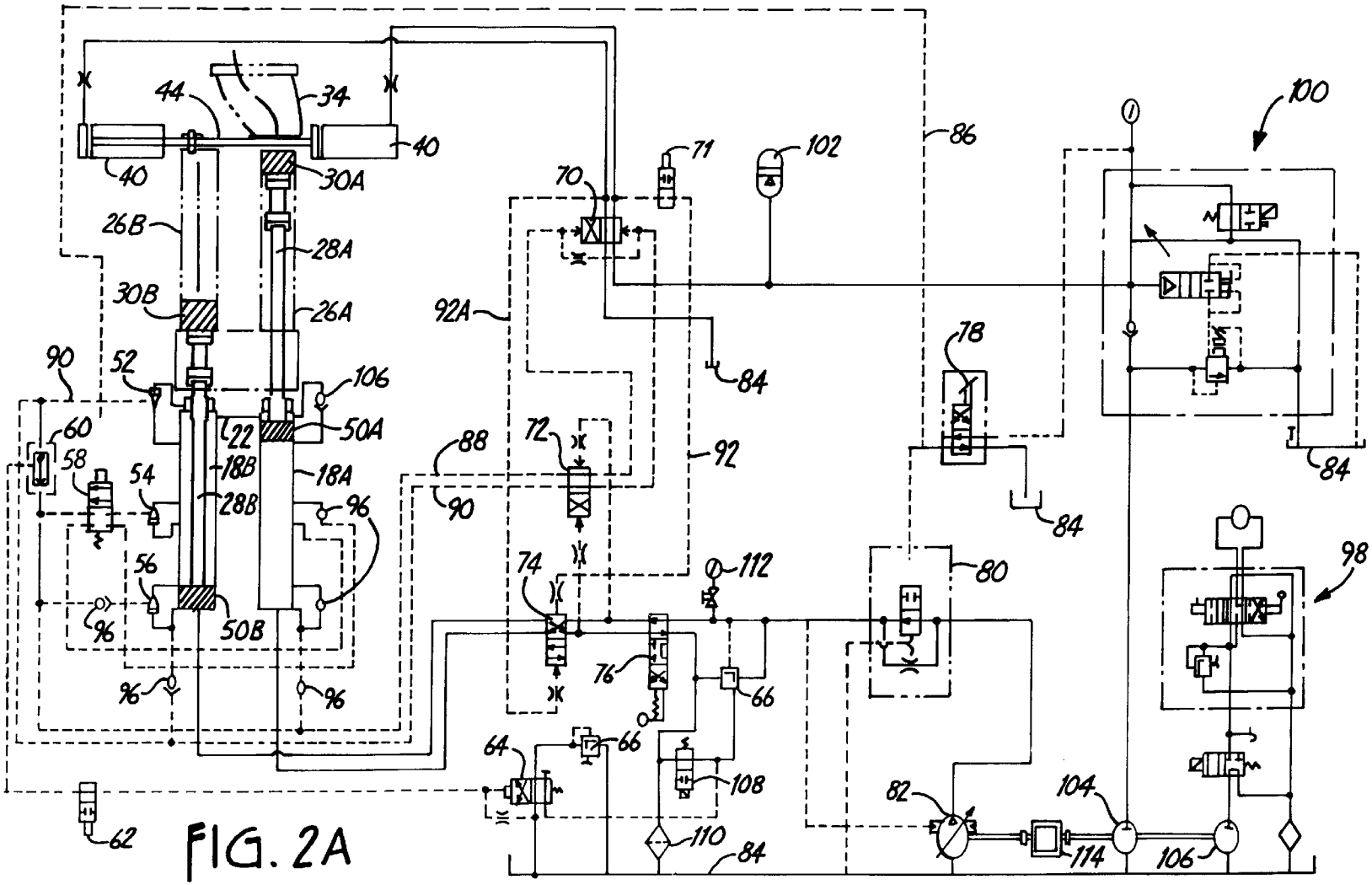
FIG. 2A is a concrete pump showing the hydraulic system as it operates in the first half of the pumping cycle in the long stroke mode.
Figure 2B:
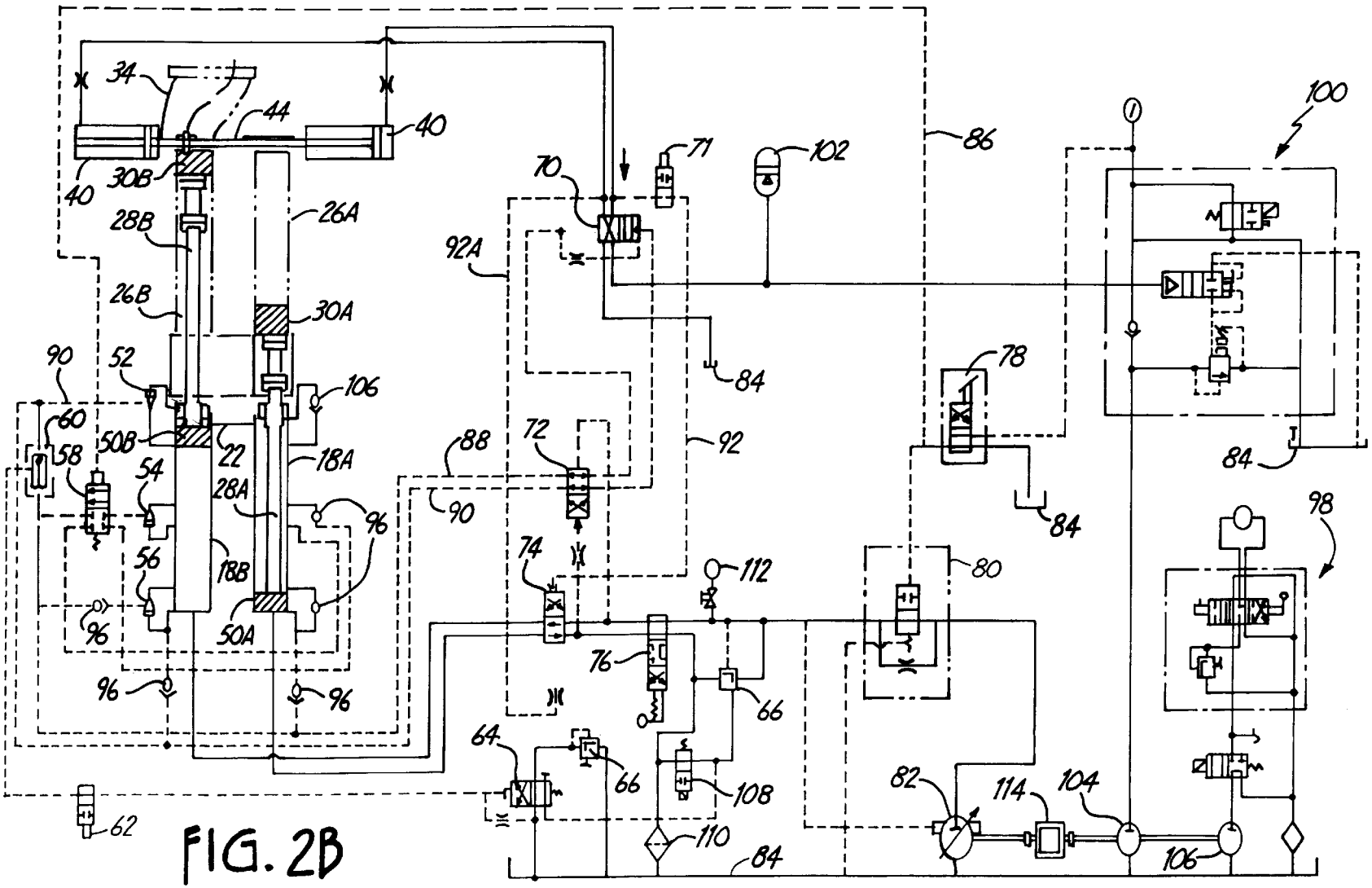
FIG. 2B is a concrete pump showing the hydraulic system as it operates in the second half of a pumping cycle in the long stroke mode.
Figure 3A:
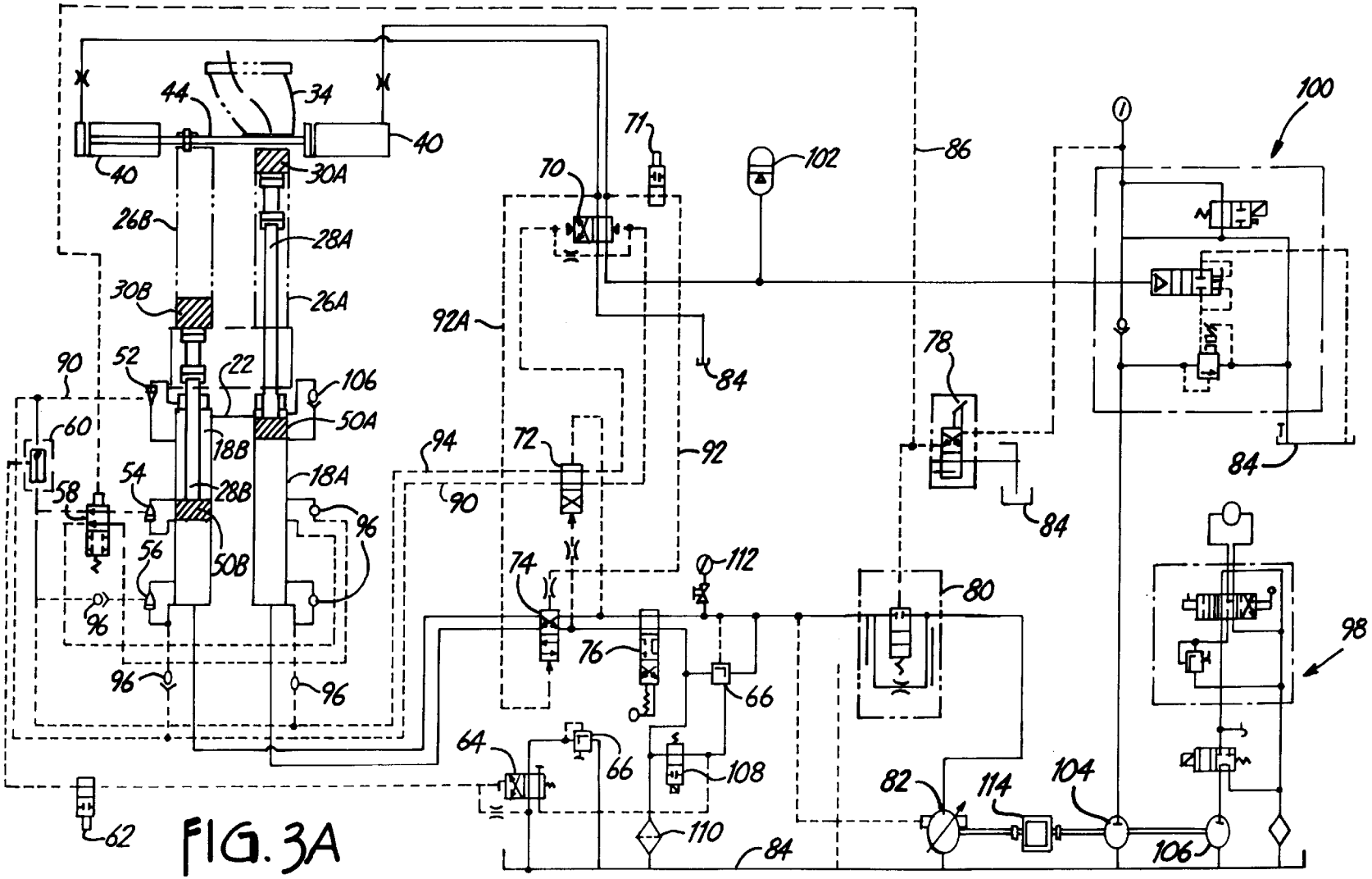
FIG. 3A is a hydraulic schematic of the concrete pump as it operates in the first half of a pumping cycle in the short stroke mode.

FIGS. 2A and 2B are hydraulic schematics showing the operation of the concrete pump in the long stroke mode, while FIGS. 3A and 31B show the operation of the concrete pump in the short stroke mode. In FIGS. 2A–3B, the solid lines indicate high pressure hydraulic fluid flow, while the dashed lines indicate a lower pressure fluid flow for signaling valves.

FIG. 2A is a schematic view of the concrete pump when the pump is operating the first half of a pumping cycle in the long stroke mode. Beginning at the left of FIG. 2A, the components of the concrete pump are output valve 34, slewing cylinders 40, slewing piston rod 44, material pistons 30A, 30B, piston rods 28A, 28B, hydraulic pistons 50A, 50B, and material cylinders 26A, 26B. Located below (as viewed in FIG. 2A) the material cylinders 26A, 26B are the first and second differential cylinders 18A, 18B. Between the first and second differential cylinders 18A, 18B there is the oil flow connection 22. Located on the second differential cylinder 18B is a logic switching valve 52, a short stroke logic switching valve 54 (short stroke valve), and a long stroke logic switching valve 56 (long stroke valve). Connected to the short stroke valve 54 is a directional valve 58. The directional valve 58 is connected to a double check valve 60, a globe valve 62, a soft switch 64, and relief valve 66.

FIG. 2A also shows a directional control valve 70, a pilot valve 72, a reciprocating cylinder valve 74, and directional valve 76 with a mechanical handle. In addition, there is a main directional valve 78 to select the long or short stroke mode, a diverter valve 80, a main hydraulic pump 82, and the hydraulic fluid tank 84. A pilot signal 86 runs from the main directional valve 78 to the directional valve 58. A long stroke pilot signal 88 runs from the long stroke valve 56 to the directional control valve 70 (via the pilot valve 72), and a return stroke pilot signal 90 runs from the logic switching, valve 52 to the directional control valve 70 (via the pilot valve 72) as well. The directional control valve 70 conveys a reversing signal 92, 92A to the reciprocating cylinder valve 74. The reversing signal 92, 92A synchronizes the directional control valve 70 and the reciprocating cylinder valve 74.

At the far right of FIG. 2A are the agitator 98 and the accumulator manifold 100. The accumulator manifold 100 acts to store energy and maintains the pressure of the hydraulic fluid at a desired level. The agitator 98 is an optional feature which can be added to the input hopper and is a device to keep the concrete stored in the hopper 38 moving to prevent premature setting. Connected to the accumulator manifold 100 is a bladder accumulator 102. The bladder accumulator 102 comprises a bladder with nitrogen which serves to maintain pressure in the hydraulic valves and the stewing cylinder 40. Also connected to the accumulator 100 is an associated fixed displacement pump 104 to supply hydraulic fluid to the accumulator system. Similarly, a gear pump 106 is used to operate the agitator 98. All the pumps 82, 104, 106 are powered by a prime mover 114, often a diesel engine.

In the lower middle area of FIG. 2A are an on/off switch 108, a filter 110, and a pressure gauge 112. The on/off switch 108 is used to turn the concrete pump on and off, and is typically an electric switch. The hydraulic fluid filter 110 is located near the tank 84 and is used to clean the fluid as it is returned to the tank 84. Finally, the pressure gauge 112 shows the pressure of the hydraulic fluid in the system.

The inventive aspect of the pump, however, centers about the ability of the pump to pump in both a long stroke and a short stroke mode. The main directional valve 78 allows the operator to choose between a long stroke or a short stroke mode. The main directional valve 78 is connected to the diverter valve 80. The diverter valve 80 is a two position, two way valve; one position allows a full flow of hydraulic fluid through the valve, and the other position restricts the flow of hydraulic fluid through the valve to about half of the full flow. When a long stroke is selected at the main directional valve 78, full flow past the diverter valve 80 occurs. When a short stroke is selected, only about 50% of the full flow amount is allowed to pass through the diverter valve 80. The diverter valve 80 can be any commercially available valve which will restrict the flow of hydraulic fluid to the desired amount via an orifice.

The diverter valve 80 is connected to the reciprocating cylinder valve 74 so that the hydraulic fluid that passes the diverter valve 80 is sent to the reciprocating cylinder valve 74. The reciprocating cylinder valve 74 is a four way directional valve, and thus allows for hydraulic fluid to flow through the valve in four directions. In the first half of the pumping cycle, the reciprocating cylinder valve 74 supplies the first differential cylinder 18A with hydraulic fluid while allowing the hydraulic fluid in the second cylinder 18B to be returned to the tank 84. Similarly, in the second half of the pumping cycle, the reciprocating cylinder valve 74 supplies the second differential cylinder 18B with hydraulic fluid while allowing the hydraulic fluid in the first cylinder 18A to be returned to tank 84.

The main directional valve 78 also sends a pilot signal 86 to the directional valve 58. In addition to being connected to a double check valve 60, the directional hydraulic valve 58 is also connected to the reciprocating cylinder valve 74 via the directional control valve 70. The pilot signal 86 from the main directional valve 78 causes the directional valve 58 to either allow or suppress a signal from the short stroke valve 54 to the reciprocating cylinder valve 74 via the directional control valve 70. The short stroke valve 54 is located on the second differential cylinder 18B midway between the logic signal valve 52 and the long stroke valve 56 (as viewed in FIG. 2A). When operating in the long stroke mode, the pilot signal 86 places the directional valve 58 in the closed position, which suppresses any signal from the short stroke valve 54. With directional valve 58 in the closed position, the long stroke valve 56 is left operational and sends a long stroke pilot signal 88 to the directional control valve 70, via the pilot valve 72.

The pilot valve 72 only operates when the pump must be reversed, such as when necessary to clear a blockage. The directional valve 76 is activated by the handle located on valve 76 and reverses the pumping action of the pump. The double check valve 60, and relief valve 62, soft switch 64, and relief valve 66 all operate to alleviate the pressure spike caused when the piston 50B reaches the bottom of its stroke. Also shown are several check valves 96. The check valves 96 prevent fluid from bleeding back into the other valves. In addition, because the concrete pump's hydraulic system may loose pressure, the check valves 96 allow for more hydraulic fluid to be added to certain areas of the hydraulic system as necessary.

The long stroke pilot signal 88 is used by the directional control valve 70 to change position of the output valve 34 by causing hydraulic fluid to flow to the slewing cylinder 40. The directional control valve 70 sends a reversing signal 92 to the reciprocating cylinder valve 74 which changes position of the reciprocating cylinder valve 74 so that the other half of the pumping cycle can begin by the opposite differential cylinder being filled with hydraulic fluid.

The material cylinders 26A, 26B are located above the differential cylinders 18A, 18B so that all cylinders 26A, 26B, 18A, 18B are axially aligned (as viewed in FIG. 2A). The piston rods 28A, 28B arc located inside the material and differential cylinders 26A, 26B, 18A, 18B. The material pistons 30A, 30B are on the top of the piston rods 28A, 28B, and the differential pistons 50A, 50B are on the bottom. Thus, as the piston rods 28A, 28B are moved back and forth through the cylinders 26A, 26B, 18A, 18B, the material pistons 30A, 30B are extended in the material cylinders 26A, 26B only, and on the other end of the piston rods 28A, 28B, the hydraulic pistons 50A, 50B are extended the length of the differential cylinders 18A, 18B only.

The hydraulic pistons 50A, 50B are driven by hydraulic fluid supplied by the hydraulic pump 82. As described above, the reciprocating cylinder valve 74 located between the hydraulic pump 82 and the differential cylinders 18A, 18B alternately supplies the cylinders 18A, 18B with fluid. The differential cylinders 18A, 18B are connected by an oil flow connection 22. Thus, as the valve 74 supplies one cylinder 18A 18B with hydraulic fluid, the piston 28A, 28B corresponding to that cylinder 18A, 18B is extended. Due to the oil flow connection 22, the opposite piston 28A, 28B is retracted.

The oil flow connection 22 is a closed loop system of hydraulic fluid located in the differential cylinders 18A, 18B above the hydraulic pistons 50A, 50B (as viewed in FIG. 2A). A set amount of hydraulic fluid is maintained above the hydraulic pistons 50A, 50B so that as the piston 50A is extended by hydraulic fluid entering the first differential cylinder 18A, the hydraulic fluid above the piston 50A is forced from the first cylinder 18A across the connection 22 and into the second differential cylinder 18B. As hydraulic fluid enters the second differential cylinder 18B above the hydraulic piston 50B, that piston rod 28B is forced downward.

As one piston rod 28B retracts, it draws material into the corresponding material cylinder 26B. As the other piston rod 28A extends, it pushes the concrete out of its corresponding material cylinder 26A, past the output valve 34 to an outlet. To complete the pumping cycle, the reciprocating cylinder valve 74 switches the flow of hydraulic fluid from the first differential cylinder 18A to the second cylinder 18B. At the same time, the directional control valve 70 reverses the position of the output valve 34 so that material in the other material cylinder 18B can be forced out. The material used in connection with the present pump is most often a type of concrete.

Thus, as is shown in FIG. 2A, moving a handle on the main directional valve 78 to the long stroke position does two things. First, it sends a pilot signal 86 to the directional valve 58, and second, it allows full flow of hydraulic fluid through the diverter hydraulic valve 80. The full flow of hydraulic fluid through the diverter valve 80 goes to the reciprocating cylinder valve 74. The reciprocating cylinder valve 74 is in a first position, so that fluid is directed to the first differential cylinder 18A, forcing the hydraulic piston 50A to extend upwards, as viewed in FIG. 2A. As the piston 50A is extended, the concrete in the material cylinder 26A is pushed by the material piston 28A toward the output valve 34. The output valve 34 is positioned so that the material in the material cylinder 26A can be pushed through the output valve 34 and to the concrete outlet.

While the first piston rod 28A is extended by the flow of hydraulic fluid from the reciprocating valve 74, the second piston rod 28B is moved in the opposite direction due to the closed amount of hydraulic fluid existing above the hydraulic pistons 50A, 50B in each differential cylinder 18A, 18B. This portion of the cylinders 18A, 18B is connected by the oil flow connection 22 and as the first piston rod 28A extends, the fluid above the hydraulic piston 50A is forced across the oil flow connection 22. The hydraulic fluid crossing the connection 22 forces the second hydraulic piston 50B to be moved downward, or forces it to retract. As the second hydraulic piston 50B retracts, concrete is drawn into the material cylinder 26B by the material piston 30B. The hydraulic fluid below the second hydraulic piston 50B is forced out of the bottom of the differential cylinder 18B, back through the valve 74, and eventually to the hydraulic tank 84.

When the second hydraulic piston 50B reaches the bottom of the second differential cylinder 18B, the long stroke logic valve 56 is activated. The long stroke valve 56 is a pressure differential valve that operates when one side of the valve 56 has less pressure than the other. When the hydraulic piston 50B reaches the valve 56, there is more hydraulic pressure above the valve 56 than below it, so as the top part of the valve 56 is closed off, fluid flows past the valve 56 to the directional control valve 70 in the form of long stroke control signal 88. Any extra pressure created when the hydraulic piston 50B reaches the bottom of the stroke is bled off the system through the double check valve 60. The directional control valve 70 changes the position of the output valve 34 and sends a reversing signal 92 to the reciprocating cylinder valve 74, which moves the reciprocating cylinder valve 74 to its second position.

FIG. 2B is a schematic view of the concrete pump when the reciprocating valve 74 is in its second position. The main directional valve 78 remains in the long stroke position, and the diverter valve 80 continues to allow full flow of the hydraulic fluid to the reciprocating valve 74. In addition, the pilot signal 86 from the main directional valve 78 continues to control the directional valve 58 so that the short stroke valve 54 is suppressed. However, as is shown in FIG. 2B, the reciprocating cylinder valve 74 has changed position so that the path of the hydraulic fluid is reversed. The directional control valve 70 also changes the position of the output valve 34.

More specifically the reciprocating cylinder valve 74 now fills the second differential cylinder 18B behind the hydraulic piston 50B with hydraulic fluid. As the hydraulic fluid enters the second differential cylinder 18B, the piston rod 28B is forced upward, forcing the material in the material cylinder 26B past the output valve 34 and to the concrete outlet. The hydraulic fluid above the hydraulic piston 50B is forced through the oil flow connection 22 to the other differential cylinder 18A, which forces the first hydraulic piston 50A to be moved downward (as viewed in FIG. 2B). When the first hydraulic piston 50A moves downward, concrete is drawn into the material cylinder 26A by the material piston 30A. The hydraulic fluid on the other side of the first hydraulic piston 50A is returned to the tank 84 via the reciprocating cylinder valve 74.

As the second hydraulic piston 50B approaches the top of the differential cylinder 18B, the logic switching valve 52 is activated. The logic switching valve 52 is a pressure differential valve that functions similarly to the long stroke valve 56. When the hydraulic piston 50B reaches the logic switching valve 52, the pressure on the top of the piston 50B is less than the hydraulic pressure below the piston 50B. Thus, hydraulic fluid flows through the logic switching valve 52 and to the directional control valve 70 in the form of return stroke pilot signal 90. The directional control valve 70 changes the position of the output valve 34 and sends a reversing signal 92A to the reciprocating cylinder valve 74. The reciprocating cylinder valve 74 moves back to its first position, illustrated in FIG. 2A, and the pumping cycle can begin again.

Figure 3B:
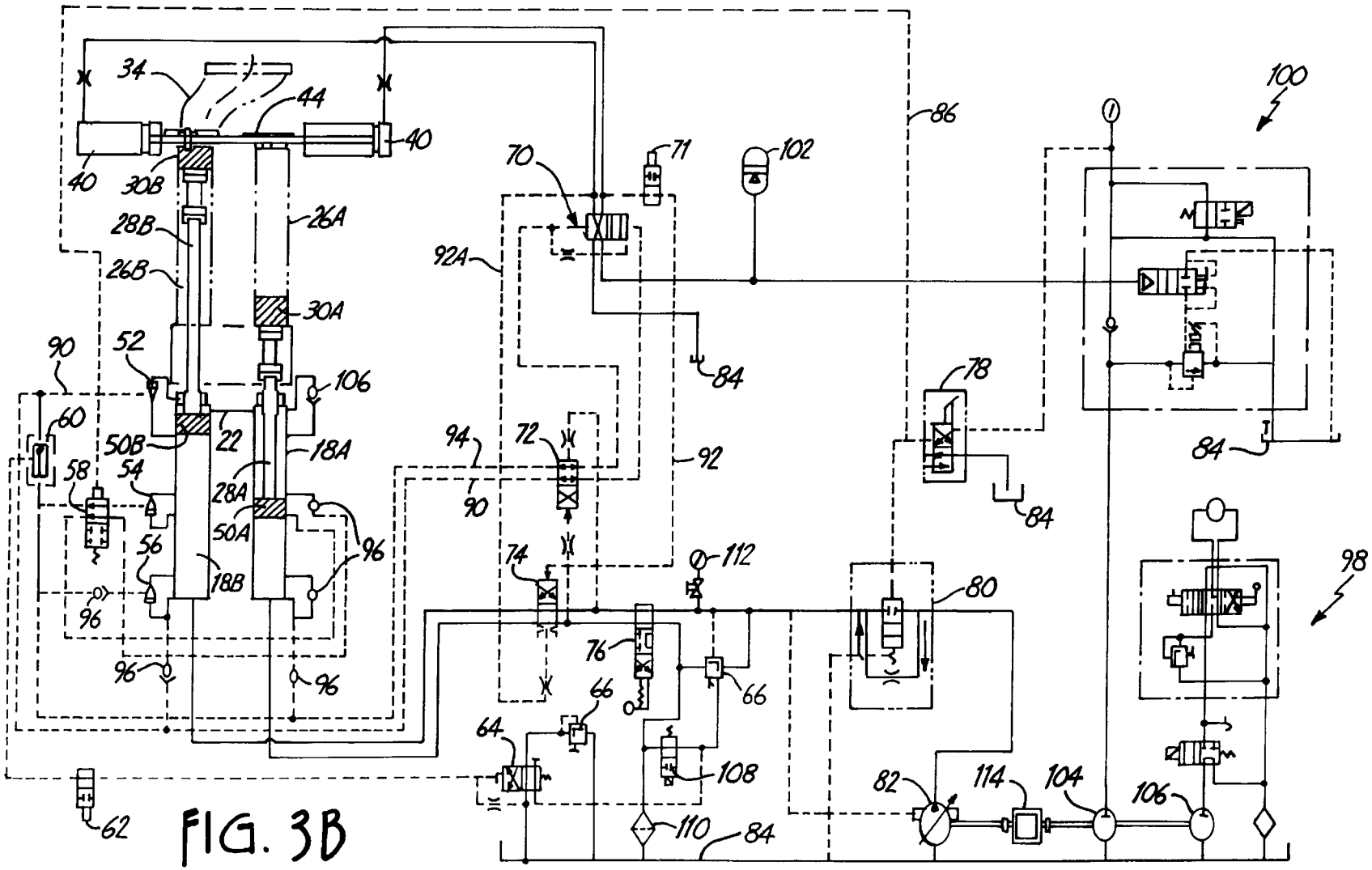
FIG. 3B is a hydraulic schematic of the concrete pump as it operates in the second half of a pumping cycle in the short stroke mode.

FIGS. 3A and 3B are schematic views of the concrete pump illustrating the concrete pump as it operates in the short stroke mode. The components of the pump remain the same, and as shown in FIG. 3A are the output valve 34, slewing cylinders 40, stewing piston rod 44, material pistons 30A, 30B, piston rods 28A, 28B, hydraulic pistons 50A, 50B, and material cylinders 26A, 26B. Located below (as viewed in FIG. 3A) the material cylinders 26A, 26B are the first and second differential cylinders 18A, 18B. Between the first and second differential cylinders 18A, 18B is the oil flow connection 22, and on the second differential cylinder 18B is the logic switching valve 52, the short stroke valve 54, and the long stroke valve 56. Connected to the short stroke valve 54 is the directional valve 58.

Also shown in FIG. 3A are the directional control valve 70, the pilot valve 72, the reciprocating cylinder valve 74, and the directional valve with a mechanical handle 76. In addition, the main directional valve 78, the diverter valve 80, the pump 82, and the hydraulic fluid tank 84 are shown. The pilot signal 86 once again runs from the main directional valve 78 to the directional valve 58. A short stroke pilot signal 94 runs from the short stroke valve 54 to the directional control valve 70 via the pilot valve 72, and a return stroke pilot signal 90 runs from the logic switching valve 52 to the directional control valve 70 via the pilot valve 72 as well. The directional control valve 70 conveys a reversing signal 92 to the reciprocating cylinder valve 74. The reversing signal 92 synchronizes the directional control valve 70 and the reciprocating cylinder valve 74.

To operate the concrete pump in the short stroke mode, the main directional valve 78 is placed in the short stroke position. This does two things, first it sends a pilot signal 86 the directional valve 58, which activates the short stoke valve 54. Secondly, placing the main directional valve 78 to the short stoke position signals the diverter valve 80, which then decreases the flow of hydraulic fluid to the reciprocating cylinder valve 74. The diverter valve 80 restricts the flow of hydraulic fluid to about half the flow allowed during long stroke operation. This restriction of the oil flow at the diverter valve 80 causes the concrete pump to pump at only a short stroke, about half of the long stroke.

More specifically, during the first half of the pumping cycle, the pump 82 pumps hydraulic fluid through the diverter valve 80, which restricts the flow of hydraulic fluid to about half of the full flow. The reduced flow of hydraulic fluid is sent to reciprocating cylinder valve 74. The reciprocating cylinder valve 74 directs the fluid to the first differential cylinder 18A and the hydraulic fluid forces the piston 50A upward (as viewed in FIG. 3A), extruding the concrete in the material cylinder 26A. At same time, hydraulic fluid is also forced through the oil flow connection 22 so that the other piston 50B is moved downward or is retracted. The oil below the piston 50B returns to the hydraulic oil tank 84 via the reciprocating cylinder valve 74. As the second piston 50B is retracted, concrete is drawn into the corresponding material cylinder 26B. The piston 50B continues to retract until the hydraulic piston 50B reaches the short stroke signal valve 54, about half way down the differential cylinder 18B.

The directional valve 58 is connected to the short stroke valve 54 and is operational due to the pilot signal 86 from the main directional valve 78. Once the piston 50B reaches the short stroke valve 54, the valve 54 operates to allow fluid flow through the short stroke valve 54 to the directional valve 58. The short stroke valve 54 is a pressure differential valve that sends a short stroke signal 94 through the directional valve 58 when the pressure across the short stroke valve 54 is not in equilibrium. From the directional valve 58, the short stroke signal 94 goes to the directional control valve 70 via the pilot valve 72. Once the signal 94 reaches the directional control valve 70, fluid is sent to the appropriate slewing cylinder 40 to change the position of the output valve 34. At the same time, a reversing signal 92 is sent to the reciprocating cylinder valve 74, which operates synchronously with the directional control valve 70. The reversing signal 92 changes the position of the reciprocating cylinder valve 74 so that the flow of hydraulic fluid to the differential cylinders 18A, 18B is reversed. A check valve 96 prevents any fluid from entering the cylinder at the long stroke valve 56.

Once the reciprocating cylinder valve 74 is moved to its second position, the other half of the short stroke pumping cycle begins as seen in FIG. 3B. The main directional valve 78 remains at the short stroke setting so that the pilot signal 86 to the directional valve 58 keeps the directional valve 58 in the open position. In addition, the main directional valve 78 allows a reduced amount of fluid to go through diverter valve 80. From the diverter valve 80, fluid travels to the reciprocating cylinder valve 74. The reciprocating cylinder valve 74 has been moved to its second position, which switches the flow path of the hydraulic fluid from the first differential cylinder 18A to the second differential cylinder 18B. As the second differential cylinder 18B is filled with hydraulic fluid, the second piston 50B is extended. As the second piston 50B is extended, the hydraulic fluid located above the hydraulic piston 50B is forced from the second differential cylinder 18B to the first differential cylinder 18A via the oil flow connection 22. The concrete that was drawn into the material cylinder 26B during the first half of the pumping cycle is thus extruded in the second half of the pumping cycle. Likewise, the first material cylinder 26A fills with concrete as the first piston 50A retracts due to the fluid coming across the oil flow connection 22.

Once the second piston 50B is fully extended, the hydraulic piston 50B reaches the logic switching valve 52. Just as in the long stroke mode, the logic switching valve 52 sends a return stroke pilot signal 90 to the directional control valve 70. The directional control valve 70 sends a reversing signal 92A to the reciprocating cylinder valve 74 and changes position of the output valve 34 by directing fluid to the appropriate slewing cylinder 40. The reversing signal 92 causes the reciprocating cylinder valve 74 to move to its first position. With the reciprocating cylinder valve 74 in its first position, the pumping cycle starts all over again.

Although the present invention has been described with reference to preferred embodiments, workers skilled in the art will recognize that changes may be made in form and detail without departing from the spirit and scope of the invention. For instance, though discussed as differential pressure valves, the logic switching valve 52, short stroke valve 54, and long stroke valve 56 may be operated by other valve or sensing means, such as electronic or pneumatic sensors or valves. Similarly, the signals may be other than hydraulic, such as electrical. Though discussed generally as using an output valve, the present invention can be utilized with any pivoting valve such as the Rock Valve™ from Schwing, an S-tube valve, a C-tube valve, ball valves, or gate valves. The pump is typically horizontally oriented, though the schematic figures of the concrete pump show a vertical orientation.

What is claimed is:

1. A pump having a long stroke and a short stroke mode, the pump comprising:

two material cylinders for moving material, each material cylinder including a hydraulic cylinder and a piston rod, wherein the piston rods are synchronized so that as one piston is extended, the other piston rod is retracted;

a valve mechanism which connects one material cylinder to an outlet and the other material cylinder to a material hopper, wherein the valve mechanism changes position so that as material exits one material cylinder at the outlet, material can enter the other material cylinder at the material hopper;

a pump supplying the hydraulic cylinders with hydraulic fluid;

a diverter valve located between the pump and the hydraulic cylinders for diverting an amount of hydraulic fluid supplied to the hydraulic cylinders;

a reciprocating cylinder valve between the pump and the hydraulic cylinders which alternately drives one piston rod by supplying hydraulic fluid to its corresponding hydraulic cylinder and allowing fluid to exit from the other hydraulic cylinder;

a short stroke valve located on one hydraulic cylinder that signals the material output valve and the reciprocating cylinder valve to change position when the piston rod reaches the short stroke valve; and a switch having a first position for selecting a long stroke mode and a second position for selecting a short stroke mode, wherein the second position activates the diverter valve and the short stroke valve.

2. The pump of claim 1 wherein the short stroke valve is a pressure differential valve.

3. The pump of claim 1 wherein the short stroke valve is located about half way down a length of the hydraulic cylinder.

4. The pump of claim 1 wherein the diverter valve diverts about half a flow of hydraulic fluid to the hydraulic cylinders when the switch is in the second position.

5. The pump of claim 1 and further comprising a long stroke valve located on one hydraulic cylinder that signals the reciprocating cylinder valve to change position when the piston reaches the long stroke valve and operates when the switch is in the first position.

6. A pump having a short stroke pumping mode and a long stroke pumping modes, the pump comprising:

first and second cylinders, wherein the first cylinder comprises a first piston driven by hydraulic fluid and the second cylinder comprises a second piston driven by hydraulic fluid;

a hydraulic pump that supplies hydraulic fluid to the first and second cylinders;

a diverter valve located between the pump and the first and second cylinders having a first and second position, wherein the first position allows a full flow of hydraulic fluid to the first and second cylinders and the second position allows a lesser flow of hydraulic fluid to the first and second cylinders than the first position; and a short stroke valve located near the middle of the second cylinder, wherein the short stroke valve is made operational when the diverter valve is in the second position and prevents the pistons from being driven a full length of the cylinders.

7. The pump of claim 6 and further comprising a long stroke valve located on the end of the cylinder wherein the long stroke valve is operational when the diverter valve is in the first position and allows the pistons to be driven a full length of the cylinders.

8. The pump of claim 6 wherein the short stroke valve is a pressure differential valve.

9. The pump of claim 6 wherein the second position of the diverter valve allows an amount of hydraulic fluid to flow to the first and second cylinders which is about half the full flow.

10. The pump of claim 6 wherein the diverter valve allows the pistons to be driven about half the length of the cylinders when in the second position.

11. A method of operating a dual cylinder displacement pump having both a long stroke mode and a short stroke mode in the short stroke mode, the method comprising:

providing a flow of hydraulic fluid to a first and second pumping cylinder to actuate them;

restricting the flow of hydraulic fluid to the first and second pumping cylinder so that about half the full amount of fluid is supplied to the pumping cylinders;

sensing a position of a piston in the first pumping cylinder at a short stroke position; and switching the flow of hydraulic fluid from one pumping cylinder to the other pumping cylinder when the piston reaches the short stroke position to allow the pistons to pump at a short stroke mode.

12. A pump having a short stroke mode and a long stroke mode, the pump comprising:

first and second material cylinders;

first and second hydraulic drive cylinders axially aligned with and connected to the material cylinders;

first and second piston rods comprising hydraulic pistons located in the hydraulic drive cylinders wherein the hydraulic pistons are driven by hydraulic fluid supplied to the hydraulic cylinders; and a hydraulic valve system for selectively operating the hydraulic pistons in a long stroke mode and a short stroke mode, the hydraulic valve system comprising a diverter valve and a short stroke valve on the first hydraulic cylinder, wherein the short stroke valve senses when the hydraulic piston reaches a short stroke position and the diverter valve diverts about half a flow of hydraulic fluid to the hydraulic drive cylinders so that a shorter stroke is made by the hydraulic piston in the hydraulic drive cylinder.

13. The pump of claim 5 wherein the short stroke position is at about a middle position of the first hydraulic cylinder.

14. A pump having a short stroke mode and a long stroke mode, the pump comprising:

first and second material cylinders;

first and second hydraulic drive cylinders connected to the material cylinders; and a hydraulic valve system comprising:

a material output valve which connects one material cylinder to an outlet and the other material cylinder to a material hopper. wherein the material output valve changes position so that as material exits one material cylinder at the outlet, material can enter the other material cylinder at the material hopper;

a pump supplying the hydraulic drive cylinders with the hydraulic fluid;

a diverter valve located between the pump and the hydraulic drive cylinders for diverting an amount of hydraulic fluid supplied to the hydraulic drive cylinders;

a reciprocating cylinder valve between the pump and the first and second hydraulic drive cylinders which alternately drives the first and second material cylinders by supplying hydralilic fluid to one of the hydraulic cylinders and allowing fluid to exit from the other of the hydraulic cylinders;

a short stroke valve located on one hydraulic drive cylinder that signals the material output valve and the reciprocating cylinder valve to change position when the material cylinder reaches a short stroke position; and a switch having a first position for selecting a long stroke mode and a second position for selecting a short stroke mode, wherein the second position activates the diverter valve and the short stroke valve, so that an amount of fluid supplied to the hydraulic drive cylinders in the short stroke mode is about half an amount of hydraulic fluid supplied to the hydraulic drive cylinders in the long stroke mode.

* * * * *